US008251410B1

(12) United States Patent
Carter et al.

(10) Patent No.: US 8,251,410 B1
(45) Date of Patent: Aug. 28, 2012

(54) ARMOR HOLD-DOWN ASSEMBLY

(75) Inventors: Rockne H. Carter, Phoenix, AZ (US); Richard F. Langner, Scottsdale, AZ (US)

(73) Assignee: Armorworks Enterprises LLC, Chandler, AZ (US)

( * ) Notice: Subject to any disclaimer, the term of this patent is extended or adjusted under 35 U.S.C. 154(b) by 362 days.

(21) Appl. No.: 12/762,046

(22) Filed: Apr. 16, 2010

Related U.S. Application Data

(60) Provisional application No. 61/214,113, filed on Apr. 20, 2009.

(51) Int. Cl.
*E05C 5/04* (2006.01)
*B62D 25/00* (2006.01)

(52) U.S. Cl. ..... 292/251; 292/1; 292/DIG. 11; 292/DIG. 31; 296/39.2

(58) Field of Classification Search ..... 292/1, 251, 292/DIG. 11, DIG. 31; 248/499; 410/107; 403/408.1; 89/36.07, 36.11; 296/39.1, 39.2, 296/39.3, 191; 52/122.1, 125.2; 49/449
See application file for complete search history.

(56) References Cited

U.S. PATENT DOCUMENTS 183,365 A * 10/1876 Birch ..... 292/301
885,866 A * 4/1908 Roy ..... 292/66
974,650 A * 11/1910 Ford ..... 220/327
1,774,141 A * 8/1930 Hills ..... 292/301
2,226,233 A * 12/1940 Shapiro ..... 220/248
2,729,231 A * 1/1956 Quest ..... 137/371
2,991,904 A * 7/1961 Carideo ..... 220/231
3,006,443 A * 10/1961 Siler ..... 403/408.1
3,284,836 A * 11/1966 Ioppolo ..... 15/313
3,449,004 A * 6/1969 Anderson ..... 403/408.1
3,747,541 A * 7/1973 Reese ..... 109/50
3,945,329 A * 3/1976 Bywater ..... 109/68
4,079,161 A * 3/1978 Kile ..... 428/220
4,213,812 A * 7/1980 Boultinghouse ..... 156/226
4,309,487 A * 1/1982 Holmes ..... 428/516
4,360,123 A * 11/1982 Blease ..... 220/323
4,404,916 A * 9/1983 Ingram ..... 109/67
4,408,546 A * 10/1983 Schmidt ..... 109/75
4,592,686 A * 6/1986 Andrews ..... 410/101
4,789,574 A * 12/1988 Selvey ..... 428/31
4,792,475 A * 12/1988 Bien ..... 428/137
4,916,000 A * 4/1990 Li et al. ..... 428/105
5,052,869 A * 10/1991 Hansen, II ..... 410/111
5,141,357 A * 8/1992 Sherman et al. ..... 403/408.1
5,248,176 A * 9/1993 Fredriksson ..... 294/215
5,267,820 A * 12/1993 Sturtevant ..... 411/551
5,322,335 A * 6/1994 Niemi ..... 296/97.23
5,722,710 A * 3/1998 Falciani ..... 296/39.1
5,738,471 A * 4/1998 Zentner et al. ..... 410/110
5,824,974 A * 10/1998 Campbell ..... 181/290
5,904,385 A * 5/1999 Linder ..... 292/336.3
6,065,917 A * 5/2000 Shambeau et al. ..... 410/107
6,082,240 A * 7/2000 Middione et al. ..... 89/36.08
6,138,975 A * 10/2000 McDaid ..... 248/499

(Continued)

*Primary Examiner* — Carlos Lugo
(74) *Attorney, Agent, or Firm* — James L. Farmer

(57) ABSTRACT

Methods and apparatus are provided for a hold-down assembly for attaching an armor panel to the floor of a vehicle utilizing an existing integrated tie-down feature. The assembly includes a base member positioned underneath the tie-down feature and aligned with a through-hole in the panel. A top positioned over both the base member and the hole in the panel at least partially overlaps the panel around the hole. A fastener extending through the top and into the base is adapted to pull the top down onto the panel, holding the panel against the floor of the vehicle.

20 Claims, 9 Drawing Sheets

U.S. PATENT DOCUMENTS 6,361,099 B1 * 3/2002 McIntosh et al. ..... 296/97.23
6,523,800 B2 * 2/2003 Hsu ..... 248/499
6,530,730 B2 * 3/2003 Swensen ..... 410/106
6,666,504 B2 * 12/2003 Guanzon et al. ..... 296/222
6,712,544 B2 * 3/2004 Kruger et al. ..... 403/408.1
6,764,259 B1 * 7/2004 Preta ..... 410/107
6,986,494 B2 * 1/2006 Strasser ..... 248/500
7,086,688 B2 * 8/2006 Edwards ..... 296/181.3
7,124,475 B2 * 10/2006 Jeffries ..... 16/445
7,455,471 B2 * 11/2008 Gawehn ..... 403/374.4
7,628,104 B2 12/2009 Warren
7,651,305 B1 * 1/2010 Boyd et al. ..... 410/111
7,685,921 B2 3/2010 Dagher
7,686,379 B2 3/2010 Lemieux
7,695,053 B1 4/2010 Boczek
8,016,339 B2 * 9/2011 Hamaguchi et al. ..... 296/39.2
8,083,113 B2 * 12/2011 Klosk ..... 224/539
8,128,146 B2 * 3/2012 Sogame et al. ..... 296/37.8
2005/0260034 A1 * 11/2005 Arbona ..... 403/408.1
2009/0133571 A1 * 5/2009 Pfister ..... 89/36.07
2010/0077913 A1 4/2010 Cunningham
2010/0083819 A1 4/2010 Mann

* cited by examiner

ARMOR HOLD-DOWN ASSEMBLY

TECHNICAL FIELD

The present invention generally relates to armor plating, and more particularly relates to attaching armor plating to interior surfaces of vehicles using existing features.

BACKGROUND

With the advent of relatively lightweight modern day composite armor materials and structures it has become feasible to retrofit many existing military vehicles, including aircraft, with ballistic armor plating. Much of the retrofit activity has been directed at armoring the floors of military vehicles, and in particular the floors of military helicopters due to their unique exposure and vulnerability to ground fire. As with any portion of a vehicle it is important that the armor plating is securely attached. With armor it is particularly important that it stay secured due to the potential for leaving portions of the vehicle unprotected if the armor were to shift or move from its intended location. In addition, the armor attachment must be robust enough to hold the armor in place under impact forces imparted by a large projectile or explosion, and prevent the armor itself from becoming a projectile inside the vehicle.

However securing armor to vehicle interiors has in many cases proven to be challenging. Government regulations and policy generally prohibit removing or replacing existing fasteners, such as for example replacing bolts or rivets holding down existing floor panels with longer bolts that could accommodate both the existing panels and a layer of armor. In addition policy generally prohibits drilling any holes in the vehicle structure, particularly aircraft, for installing new fasteners. Thus retrofit armor designers and installers typically must utilize the available holes and attachment features to secure armor plating. However the existing features are often insufficient in quantity, not located where needed, or not readily adaptable for attaching armor plating. Further complicating the situation, it is generally desirable or required that the retrofit armor be relatively easy and quick to install, preferably with few or no tools.

Accordingly, a need exists for a robust means of attaching armor plating to the inside surfaces of military vehicles that will secure the armor at all times, including when the armor is subjected to explosive forces. A further need exists for a means of attaching armor plating to vehicle interior surfaces without drilling holes or removing existing fasteners. A further need exists for a means of attaching armor to interior surfaces of military vehicles using existing attachment features.

SUMMARY

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment" do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises an apparatus for attaching a panel to an interior surface of a vehicle utilizing an existing attachment feature in the vehicle. The exemplary apparatus comprises a base positioned to support the existing vehicle attachment feature, and aligned with a through-hole in the panel. The apparatus further comprises a top positioned over both the base member and the hole in the panel, the top at least partially overlapping the panel around the hole. A fastener connecting the top to the base is adapted to pull the top down onto the panel and hold the panel against the interior surface of the vehicle.

According to another exemplary embodiment, a method is provided for attaching a panel to an interior surface of a vehicle utilizing an existing attachment feature on the interior surface. The method comprises positioning a base under the existing attachment feature, and placing the panel over the interior surface of the vehicle with a through-hole in the panel aligned above the base and the existing attachment feature. A top is placed over the hole in the panel, at least partially overlapping the panel around through-hole. A fastener is inserted through a hole in the top and connected to the base. The fastener is tightened, clamping the panel between the top and the interior surface of the vehicle, and trapping the attachment feature between the base and the top.

Furthermore, other desirable features and characteristics of the present invention will become apparent from the subsequent detailed description and the appended claims, taken in conjunction with the accompanying drawings and the foregoing technical field and background.

BRIEF DESCRIPTION OF THE DRAWINGS

The present invention will hereinafter be described in conjunction with the following drawing figures, wherein like numerals denote like elements, and wherein.

DETAILED DESCRIPTION

Figure 1:
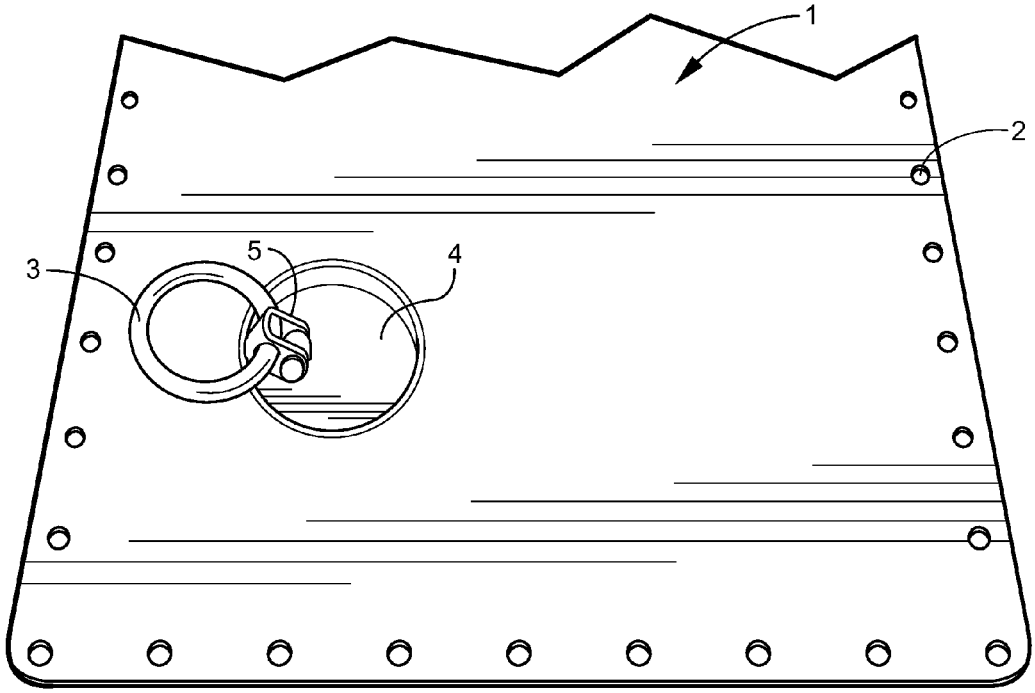
FIG. 1 is a perspective view of a prior art cargo tie-down ring recessed in a vehicle floor.

The present invention is described more fully hereinafter with reference to the accompanying drawings and/or photographs, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Referring now specifically to the drawings, the armor hold down assembly in accordance with the present invention makes use of a vehicle's existing tie down features as a low profile means for fastening panels, such as for example ballistic armor plating, to the vehicle. As previously stated, an objective of the present invention is to provide a means for attaching armor plating to inside surfaces of military vehicles. More specifically for example, in the case of vehicle flooring, it is desirable and an objective of the present invention that the armor is attached atop the existing flooring, with the existing flooring remaining in place beneath the armor plating. Accordingly the top surface of the armor plating in such installations may serve as the exposed flooring, configured as desired with an appropriate wear resistant or friction surface.

Figure 2:
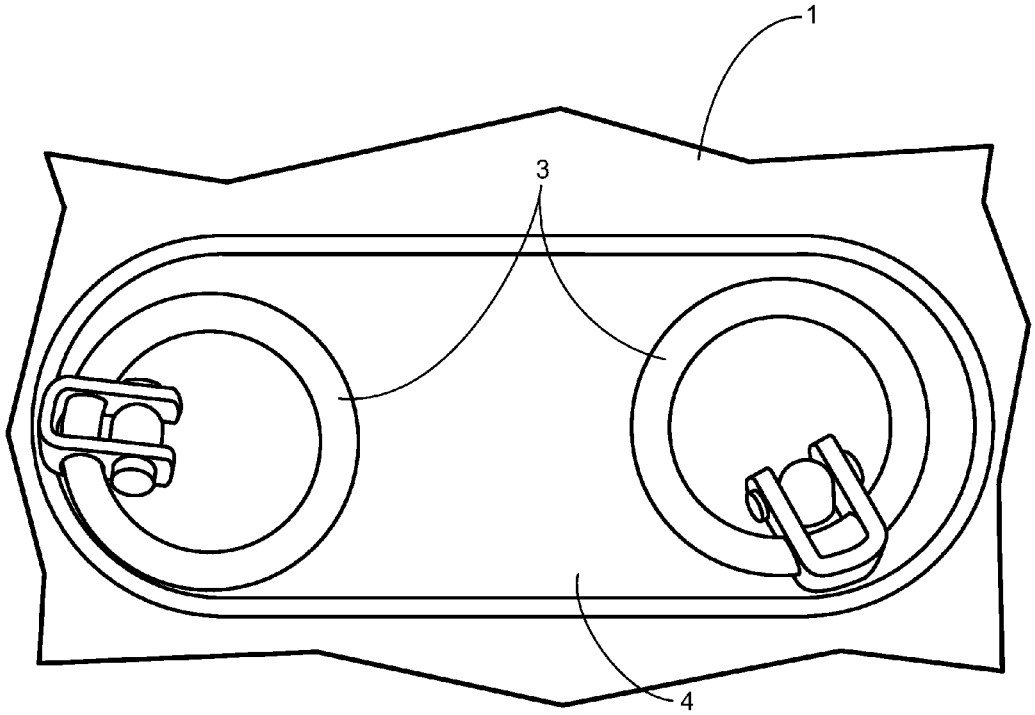
FIG. 2 depicts a pair of cargo tie-down rings mounted in an elongated recess.

FIG. 1 is representative of a floor panel 1 of the type used in military vehicles, and in particular military aircraft. In aircraft for example, the floor panel may be a composite structure consisting of top and bottom skins separated by a honeycomb material. In such floor structures the skins are usually aluminum, with the top skin presenting a corrugated or "diamond" surface for occupant safety. A series of holes 2 are disposed around the perimeter of the floor panel for receiving bolts or rivets used to attach the panel to the underlying vehicle structure. As previously mentioned, existing fasteners such as the perimeter bolts are for various reasons generally not available for attaching armor plating. A tie down ring 3 is anchored to the bottom of a cup 4 which is welded into a cut-out or recess in floor panel 1. The cup 4 may for example be circular as shown in FIG. 1 and contain one tie-down ring, or elongated as shown in FIG. 2 for accepting two tie-down rings. The tie-down ring 3 is attached to a post in the bottom of the cup 4 with a bracket 5 that allows the ring to pivot from an open position shown in FIG. 1 to a stowed position as shown in FIG. 2. When in stowed position the ring sits inside cup 4 roughly flush with or slightly proud of the top surface of the floor panel 1. Cargo tie-down features such as tie- down ring 3 are load rated, thus advantageously providing a convenient means for assessing the capacity of available attachment features against the load requirements of the panel or structure being held down.

Figure 3:
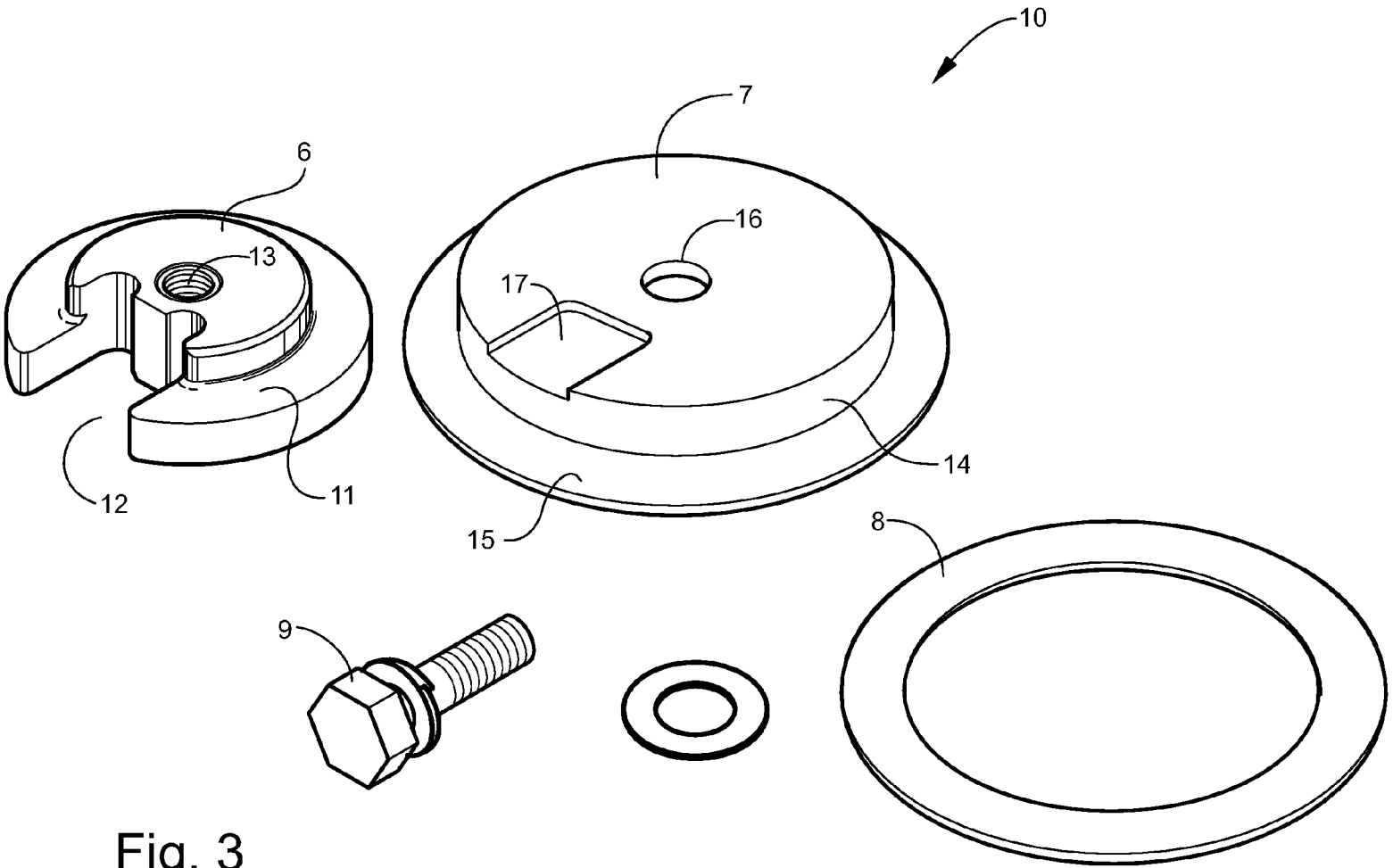
FIG. 3 is a perspective view of the components comprising an armor hold down assembly in accordance with the present invention.
Figure 4:
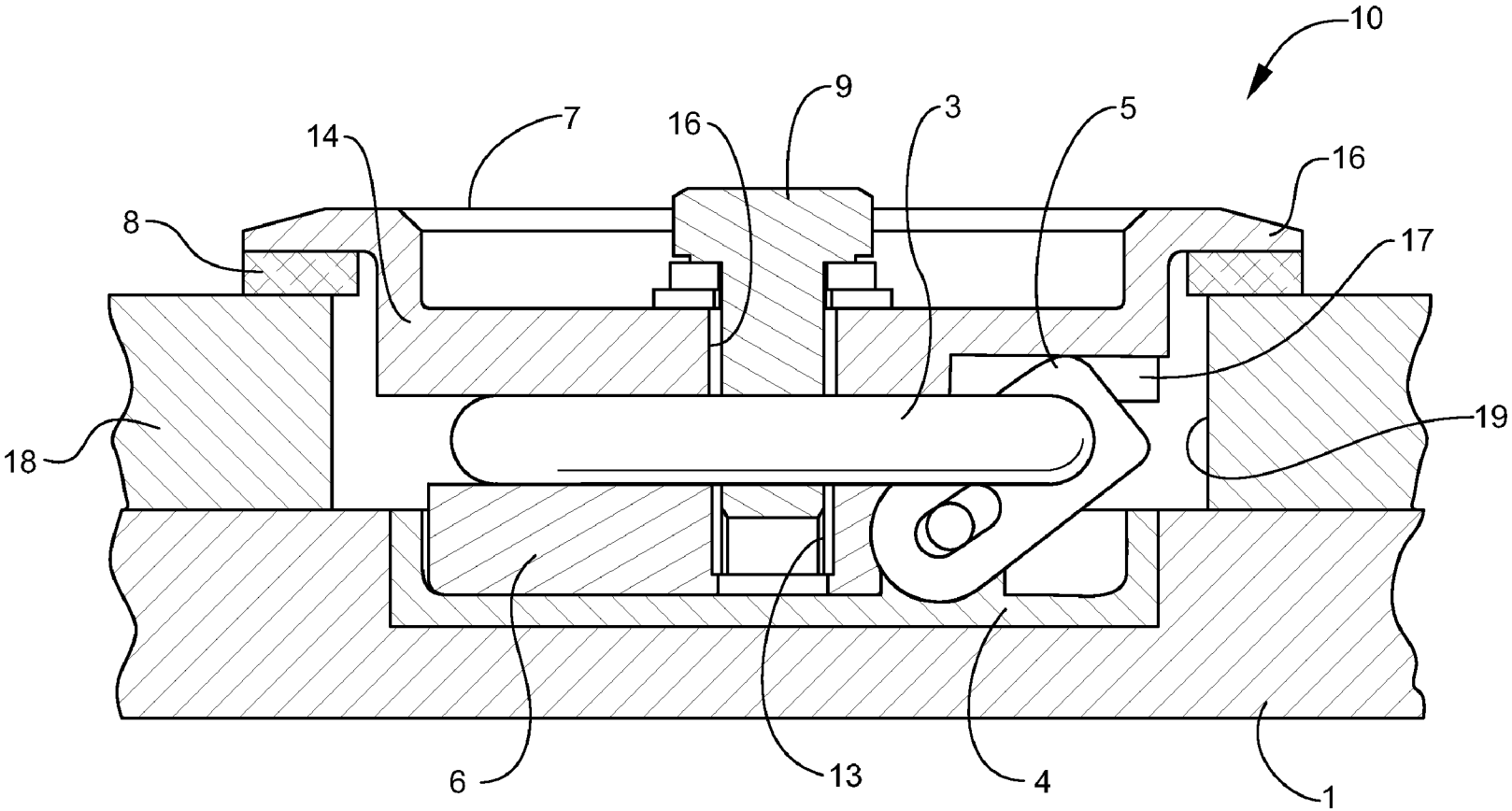
FIG. 4 is a cross-section of an exemplary armor hold down assembly installed at a vehicle tie-down ring location.
Figure 5:
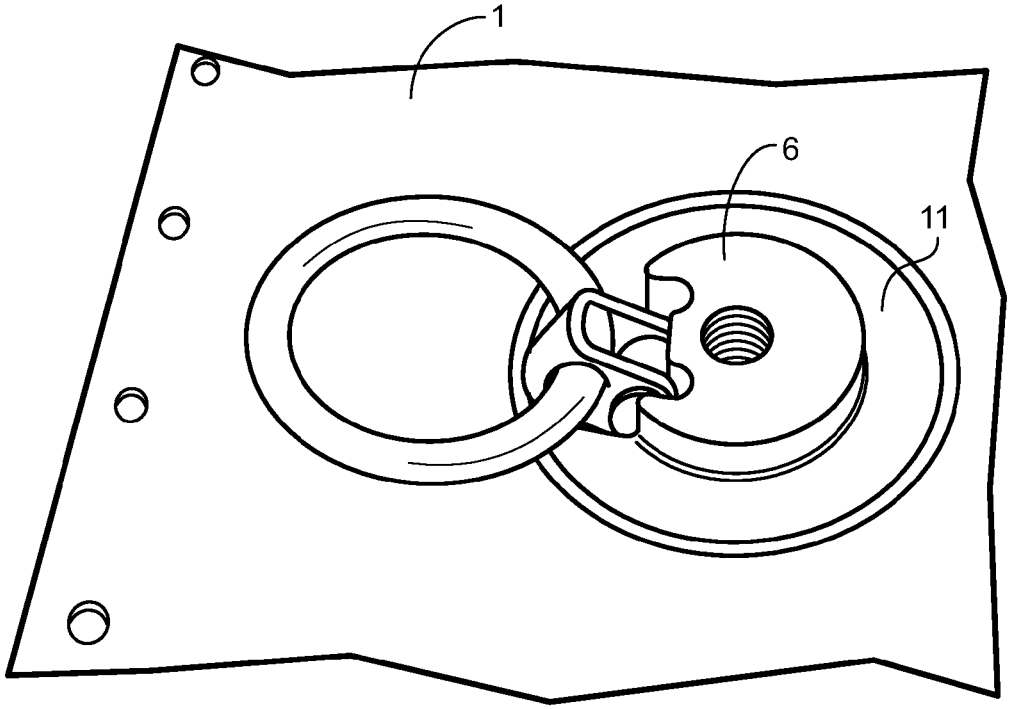
FIGS. 5 through 11 are sequential views demonstrating installation of the exemplary armor hold down assembly at a vehicle tie-down ring location.

FIGS. 3 and 4 depict an exemplary armor hold down assembly (indicated generally by reference numeral 10) in accordance with the present invention. The armor hold down assembly 10 is fundamentally a two part assembly comprising a base 6, and a top 7 (shown upside down). The base 6 is generally circular with an outside diameter that is preferably slightly less than the inside diameter of the cup 4 in floor panel 1. A groove 11 is provided around the top of the base 6 for receiving the tie down ring 3. The depth of groove 11 is preferably approximately equal to or slightly less than the thickness of tie down ring 3. An exemplary base 6 further includes a cut-out 12 to accommodate the tie-down ring attachment bracket 5, and a threaded hole 13 for receiving bolt 9.

The top 7 of the armor hold down assembly 10 comprises a cylindrical recessed portion 14, and a perimeter flange portion 15. The cylindrical recessed portion 14 is sized to sit within a corresponding hole in an armor plate, with the flange portion 15 extending outward from the cylindrical portion 14 to overlap the armor plate. Top 7 further comprises a clear-hole 16 for bolt 9, and a depression 17 to provide clearance for the tie down ring attachment bracket 5. Base 6 and top 7 are preferably made of a high strength material, such as for example high strength aluminum, or armor steel. In one preferred embodiment the material for both is 6061-T6 Aluminum.

Figure 6:
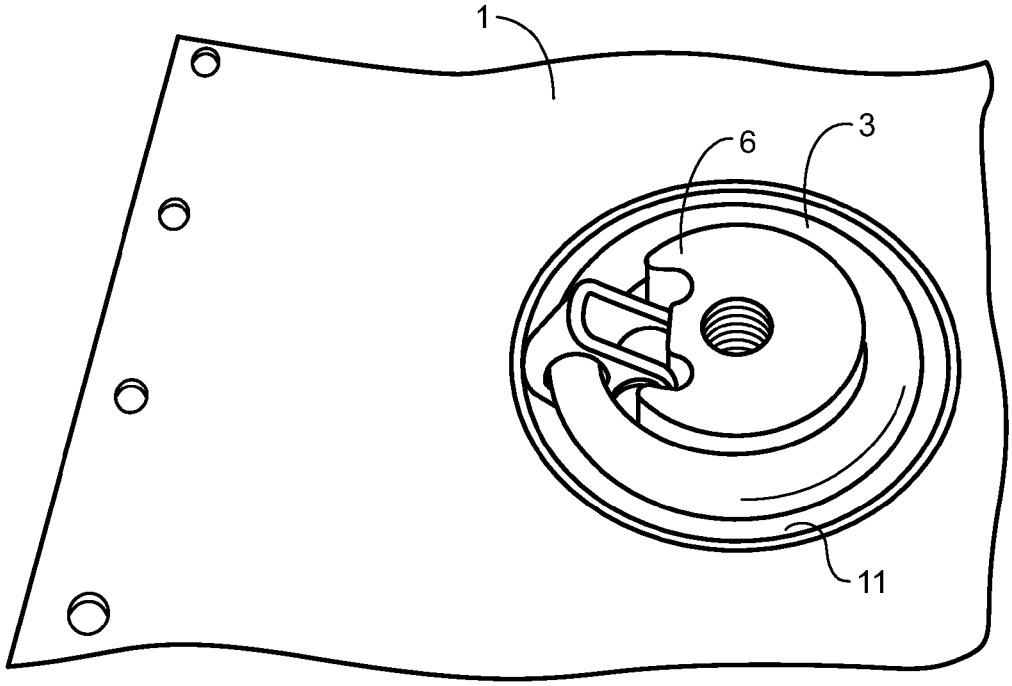

The installation of an armor plate using an exemplary armor hold down assembly will now be described with particular reference to FIGS. 5 through 10. Beginning with FIG. 5, the base 6 is placed in the cup 4 with the tie down ring 3 in the open position. Base 6 is preferably oriented with the groove 11 facing up, and the cut out 12 aligned with the tie-down ring bracket 5. The tie down ring 3 is then pivoted to the previously mentioned closed position such that it sits within groove 11 of base 6 as shown in FIG. 6.

Figure 7:
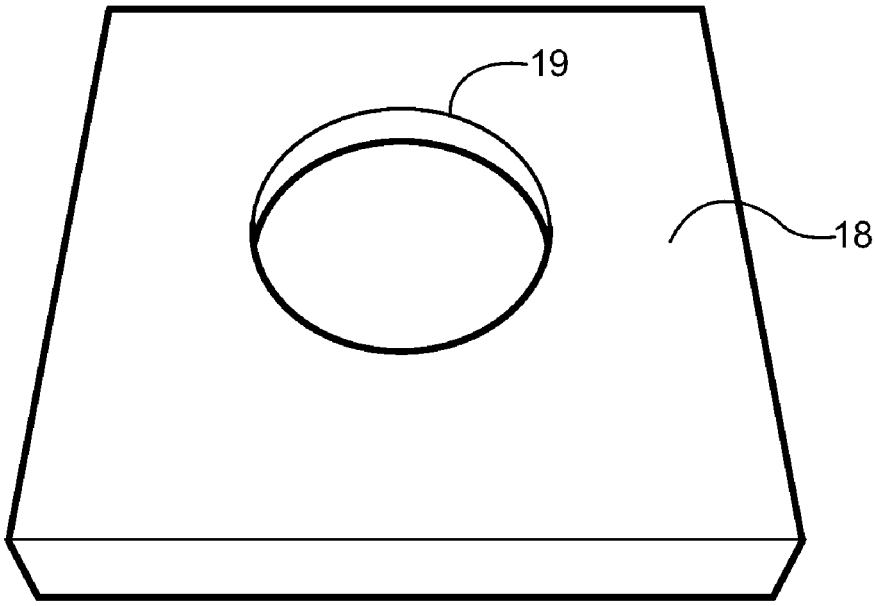

FIG. 7 depicts a portion of an armor plate 18 for use in conjunction with the armor hold down assembly. The armor plate may comprise any suitable material such as for example steel, or various composite materials or structures. In one embodiment the armor plate 18 comprises a combination of a ceramic strike plate with a high-strength ballistic fiber composite backing. Exemplary structures and materials are disclosed for example in U.S. Pat. Nos. 4,916,000, 4,079,161, 4,309,487, and 4,213,812, the entire contents of which are incorporated by reference. The armor plate is preferably fabricated into panels with one or more integrated holes 19 positioned to align with existing attachment features such as the tie-down rings. It should be noted however that although particular attention is devoted herein to armor plating, the present invention is useful for attaching any kind of panel or structure to the interior of aircraft surfaces, such as for example various types of sound or thermal insulation panels and the like.

Figure 8:
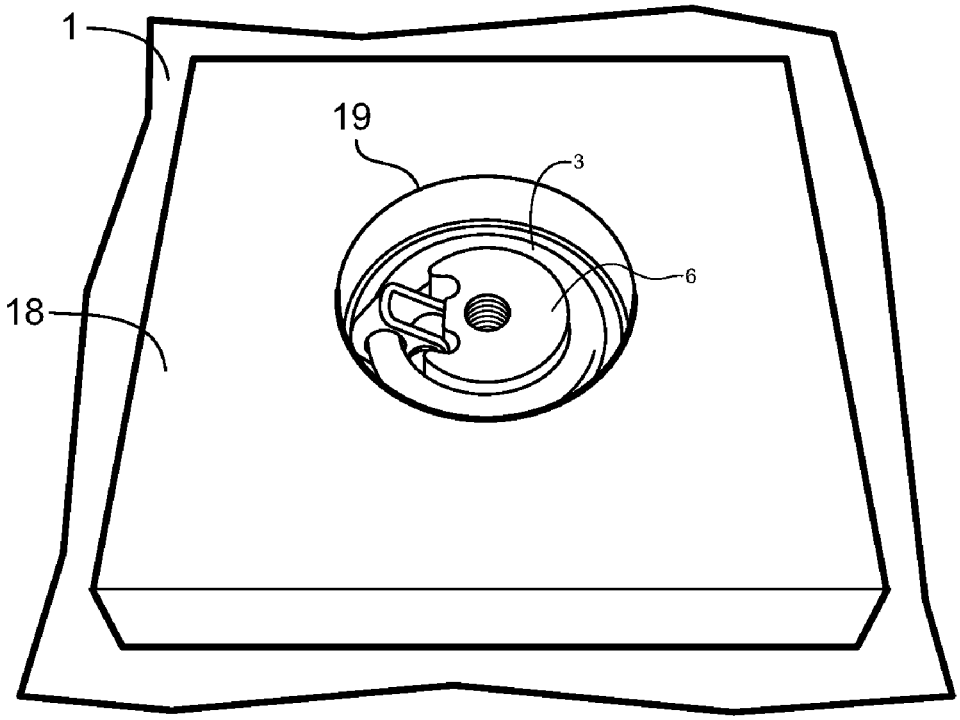
Figure 9:
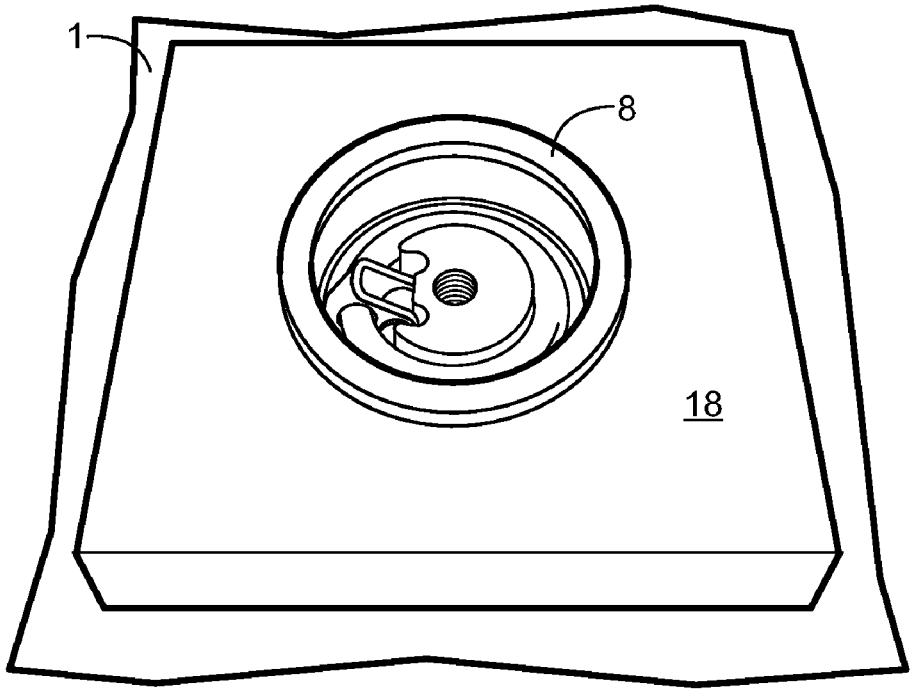
Figure 10:
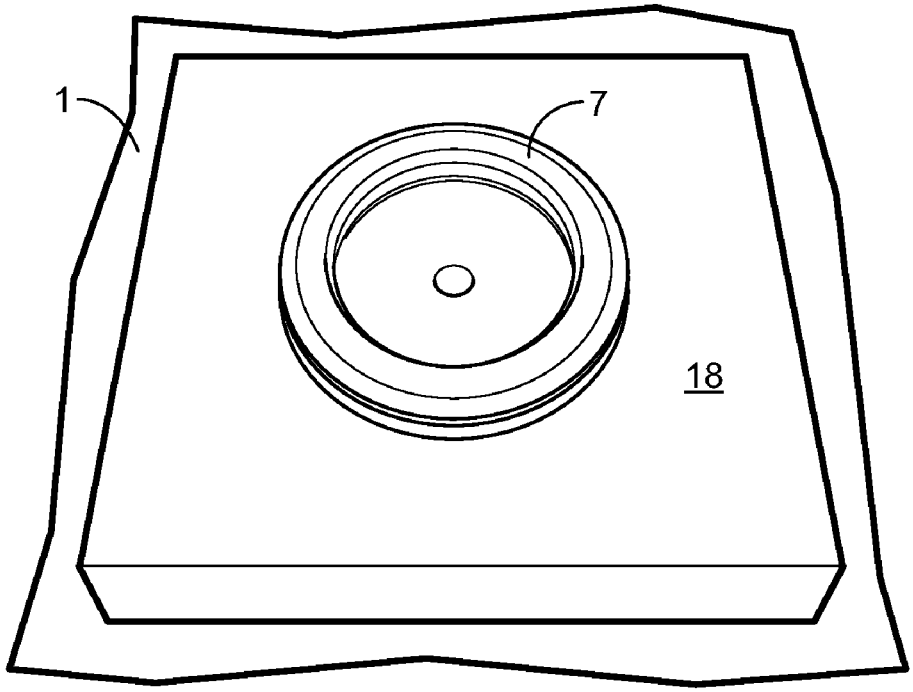
Figure 11:
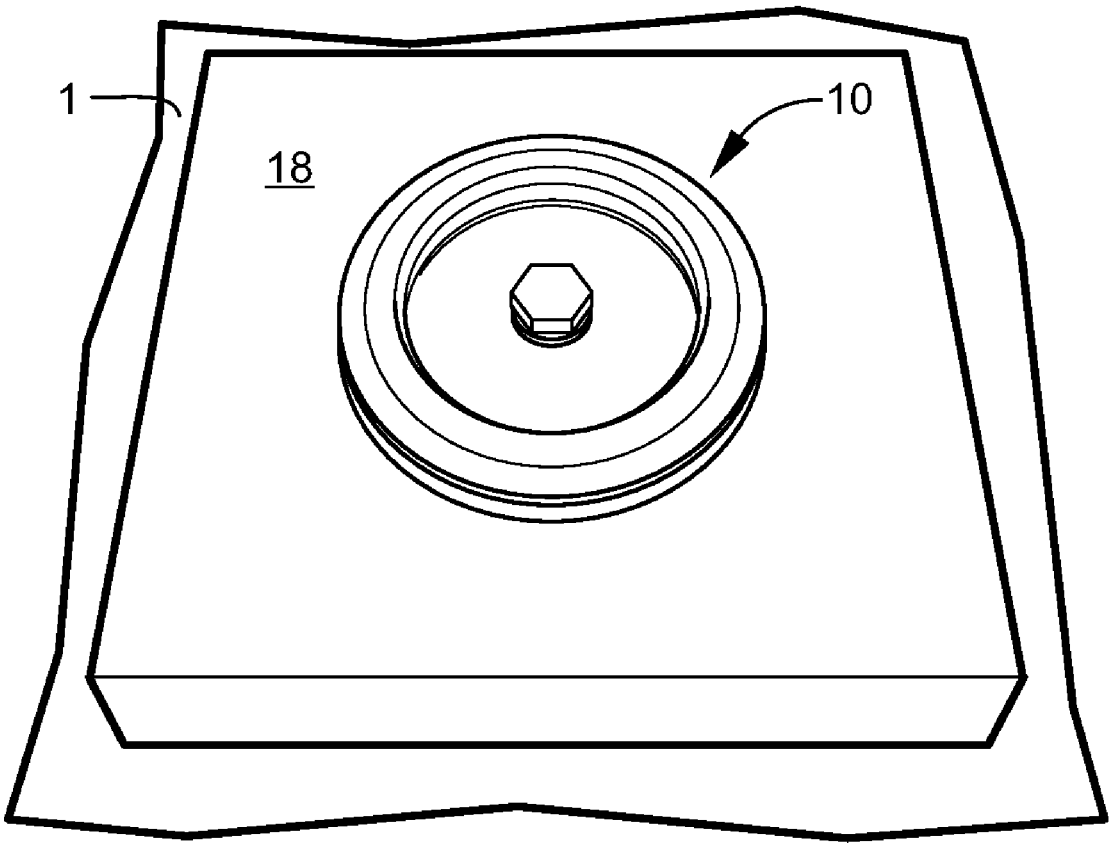

FIG. 8 shows the armor plate 18 placed atop the vehicle floor panel 1 with the hole 19 exposing the tie down ring 3 and base 6. The hole 19 in the armor plate is preferably large enough such that it surrounds the rim of cup 4 with a slight clearance, allowing the armor plate to sit flat against the floor panel. A gasket 8 is placed atop the armor in surrounding relationship to hole 19 as shown in FIG. 9. The gasket 8 is preferably a compressible material, such as for example neoprene rubber. Top 7 is placed on gasket 8 as shown in FIG. 10, and positioned such that cylindrical portion 14 of top 7 projects into hole 19 in armor plate 18. The bolt 9 is inserted through clear-hole 16 in top 7, threaded into the hole 13 in base 6, and then tightened to complete the installation as shown in FIG. 11.

As best seen in FIG. 4, the armor plate 18 and tie-down ring 3 are both trapped by the hold down assembly, with the armor plate 18 trapped between the top 7 and floor panel 1, and tie-down ring 3 trapped between the base 6 and top 7. Tightening bolt 9 pulls the base 6 up against the underside of tie-down ring 3, which in turn pulls up on floor panel 1. Simultaneously top 7 is drawn down against the gasket 8 and the armor plate 18 under it by bolt 9, clamping the armor plate 18 down against the floor panel 1. The thickness of gasket 8 is preferably selected such that the armor plate is clamped against the floor panel with adequate pressure before the top 7 bottoms out against the tie-down ring 3 and base 6.

Advantageously the head of bolt 9 sits in the recessed portion of top 7 such that the assembly as a whole presents a very low profile, reducing the possibility of it becoming a trip hazard when used on floor armor. In a further advantage the present invention enables the installation of armor panels with a wrench for tightening bolt 9 as the only tool needed for the installation. Yet another advantage afforded by the invention is the ability to assess the known load ratings of the existing vehicle tie-down points against load requirements of the panels or structures being installed.

Figure 12:
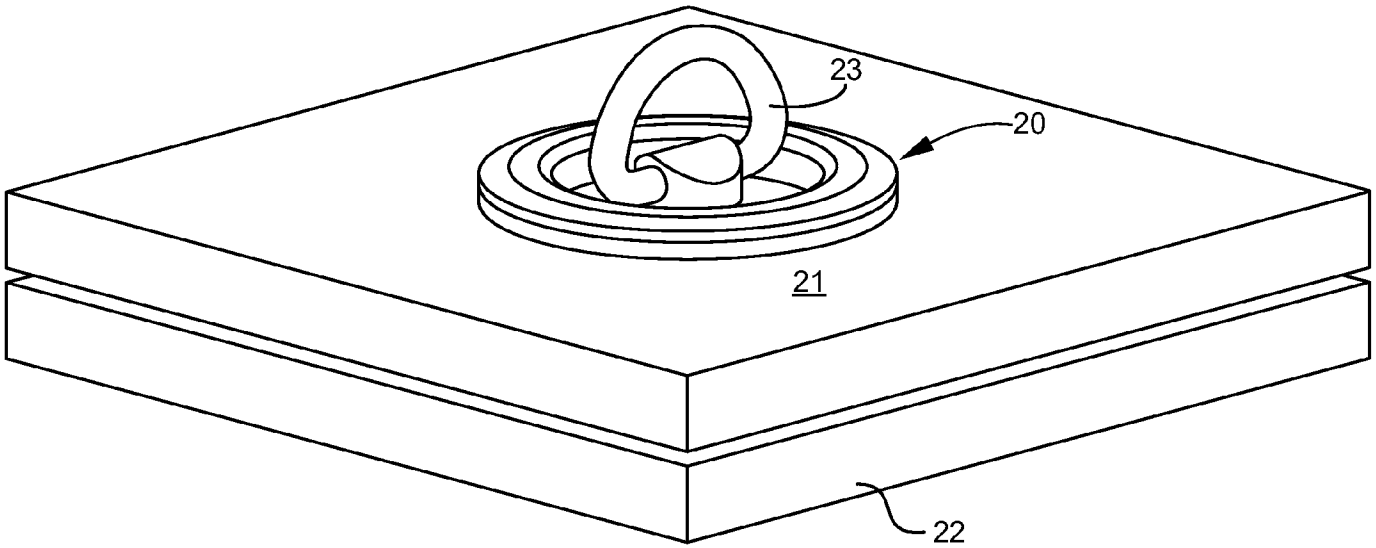
FIGS. 12 and 13 depict an exemplary armor hold down assembly with a recessed D-ring.
Figure 13:
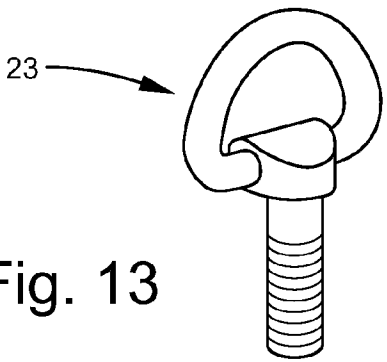

In another embodiment of the present invention, the existing vehicle tie down can be replaced with a new tie-down ring assembly, restoring the tie-down ring position that was used for hold-down installation. Referring to FIGS. 12 and 13, an armor hold down assembly 20 in accordance with the present invention is used to attach a panel 21 to an existing vehicle surface 22. However, bolt 9 used in the previously described embodiment of the hold down assembly is replaced by an integrated D-ring bolt 23 threaded into a base 6 in the same manner. The D-ring portion is large enough that bolt 23 may be sufficiently hand tightened to hold down panel 21. After tightening, the D-ring portion can be pivoted down to sit within the recessed portion of top 7 to again present a low profile armor hold down, while restoring the original cargo tie-down position.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

What is claimed is:

1. An apparatus for attaching a panel to an interior surface of a vehicle, the interior surface having at least one cut out that receives an attachment feature that includes a cup attached to the cut out and a tie down attachment member mounted to the cup, the apparatus comprising:

a base member positioned within the cup and adapted to support the attachment member, and being aligned with a hole in the panel when the panel is positioned against the surface;

a top positioned over the panel to overlap the panel around the hole;

a fastener connecting the top to the base member adapted to pull the top down onto the panel and hold the panel against the interior surface.

2. The apparatus of claim 1, wherein the panel is armor plating.

3. The apparatus of claim 2, wherein the vehicle is an aircraft.

4. The apparatus of claim 3, wherein the tie down attachment member is a cargo tie-down ring, and the tie-down ring is trapped between the base and the top.

5. The apparatus of claim 4, wherein the fastener is a bolt inserted down through a hole in the top and screwed into a threaded hole in the base.

6. The apparatus of claim 4, wherein the base is generally circular and has a groove to receive the tie-down ring such that, when seated, a substantial portion of the tie-down ring is within the groove and below the top surface of the base.

7. The apparatus of claim 1, wherein the top includes a recessed cylindrical portion projecting into the hole in the panel, and a perimeter flange portion overlapping the panel around the hole.

8. The apparatus of claim 7, further comprising a gasket between the perimeter flange portion of the top and the panel.

9. The apparatus of claim 1, wherein the inside surface of the vehicle is a floor.

10. The apparatus of claim 5, wherein the bolt further comprises a D-ring.

11. A method of attaching a panel to an interior surface of a vehicle, the interior surface having a cut out that receives an attachment feature that includes a cup attached to the cut out and a tie down attachment member mounted to the cup, the method comprises the steps of:

positioning a base member within the cup for supporting the attachment member;

positioning the panel against the interior surface so that a hole on the panel is aligned with the attachment feature and the base member;

covering the hole in the panel with a top that overlaps the panel around the hole;

inserting a fastener through an aperture on the top and connecting the fastener to the base member; and tightening the fastener to pull the top down onto the panel to clamp the panel between the top and the interior surface of the vehicle and trap the attachment feature between the base and the top.

12. The method of claim 11, wherein the existing attachment feature comprises a tie-down ring pivotable between a stowed position within the cup, and an open position with the ring substantially out of the cup.

13. The method of claim 12, wherein the step of positioning the base member within the cup for supporting the attachment member comprises the steps of:

positioning the base within the cup with the tie-down ring in the open position; and pivoting the tie-down ring onto the base.

14. The method of claim 11, wherein the panel comprises ballistic armor, the vehicle is an aircraft, and the interior surface of the vehicle is the floor.

15. A hold-down assembly for attaching an armor panel to the floor of a vehicle, the floor having a cutout that receives an attachment assembly that includes a cup attached to the cutout and a pivotable cargo tie-down ring mounted to the cup, the assembly comprising:

a base member positioned underneath the tie-down ring and aligned with a through-hole in the panel when the panel is positioned against the surface;

a top positioned over both the base member and the hole in the panel, the top overlapping the panel around the hole; and a bolt extending through a hole in the top and threaded into the base, the assembly configured such that tightening the bolt pulls the top down onto the panel, thereby holding the panel against the floor of the vehicle.

16. The hold-down assembly of claim 15, wherein the vehicle is an aircraft.

17. The hold-down assembly of claim 15, wherein the base is generally circular and has a groove to receive the tie-down ring such that, when seated, a substantial portion of the tie-down ring is within the groove and below the top surface of the base.

18. The hold-down assembly of claim 15, wherein the top includes a recessed cylindrical portion projecting into the hole in the panel, and a perimeter flange portion overlapping the panel around the hole.

19. The hold-down assembly of claim 18, further comprising a gasket between the perimeter flange portion of the top and the panel.

20. The hold-down assembly of claim 15, wherein the bolt further comprises a pivotable D-ring.

* * * * *